US005984021A

United States Patent [19]

Pascale

[11] Patent Number: 5,984,021

[45] **Date of Patent: *Nov. 16, 1999**

[54] PORTING SYSTEM FOR BACK CHAMBER OF PNEUMATIC HAMMER

[75] Inventor: Jack H. Pascale, Greentown, Pa.

[73] Assignee: Numa Tool Company, Thompson, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/014,072

[22] Filed: Jan. 27, 1998

[51] Int. Cl.[6] ..... B23Q 5/33

[52] U.S. Cl. ..... 173/90; 173/17; 173/73; 173/78; 173/115

[58] Field of Search ..... 173/17, 13, 14, 173/15, 16, 91, 92, 73, 78, 115

[56] References Cited

U.S. PATENT DOCUMENTS

| | | | |
|---|---|---|---|
| 2,979,033 | 4/1961 | Bassinger | 173/73 |
| 3,193,024 | 7/1965 | Cleary | 173/17 |
| 3,229,775 | 1/1966 | Cleary | 173/17 |
| 3,924,690 | 12/1975 | Shaw | 173/115 |
| 4,312,412 | 1/1982 | Pillow | 173/17 |
| 4,333,537 | 6/1982 | Harris et al. | 173/17 |
| 4,530,408 | 7/1985 | Toutant | 173/17 |
| 4,932,483 | 6/1990 | Rear | 175/296 |
| 5,205,363 | 4/1993 | Pascale | 173/17 |
| 5,350,023 | 9/1994 | Klemm | 173/17 |
| 5,419,403 | 5/1995 | Klemm | 173/115 |

FOREIGN PATENT DOCUMENTS 2 219 817 12/1989 United Kingdom .

*Primary Examiner*—Peter Vo
*Assistant Examiner*—James P. Calve
*Attorney, Agent, or Firm*—Alix, Yale & Ristas, LLP

[57] ABSTRACT

A pneumatic downhole impact drill has a porting system for automatically supplying pneumatic pressure fluid from a fluid delivery tube received within an axial bore in the impact piston to the opposite ends of the piston operating cylinder as the piston reciprocates. A flange on the delivery tube is slidably mounted in a cavity in a mounting hub assembly. Passageways provide fluid communication between the pressure fluid inlet plenum and the operating chamber side of the cavity and between the back chamber and the inlet plenum side of the cavity. Fluid pressure forces acting on the opposite faces of the flange and on the top end surface of the delivery tube reciprocate the delivery tube between upstroke and downstroke positions. Positioning the delivery tube in the upstroke position increases the axial distance that the piston must travel before the pressure fluid supply is connected to the back end of the operating chamber on the piston upstroke. Positioning the delivery tube in the downstroke position increases the axial distance the piston must travel before the pressure fluid supply is disconnected from the back end of the operating chamber on the piston downstroke.

8 Claims, 5 Drawing Sheets

PORTING SYSTEM FOR BACK CHAMBER OF PNEUMATIC HAMMER

BACKGROUND OF THE INVENTION

This invention relates generally to pneumatic impact hammers of the type having an impact piston and a fluid delivery tube received within a coaxial bore in the piston for supplying pneumatic pressure fluid to one or both ends of the piston operating chamber for reciprocation of the piston.

U.S. Pat. No. 5,205,363 discloses a pneumatic impact drill having a porting system for automatically supplying pneumatic pressure fluid from a fluid delivery tube received within a coaxial bore in the impact piston to the opposite ends of the piston operating cylinder as the piston reciprocates. The porting system comprises an annular set of equiangularly spaced outlet ports in the fluid delivery tube and two sets of radially extending bores in the piston having first and second, axially spaced, annular sets of equiangularly spaced inlet ports which cooperate with the outlet ports in the delivery tube. The number of inlet ports in the piston and the number of outlet ports in the supply tube are selected to provide substantial fluid communication therebetween at all relative angular positions of the piston and fluid delivery tube.

Such invention provides a new and improved porting system. However, this porting system uses a single fluid delivery tube port to complete alternative flow paths for the two axially spaced piston ports and requires axial piston movement to initiate transfer from the first flow path to the second flow path. Consequently, pressure conditions that impede the movement of the piston can exist while the fluid delivery tube port is positioned intermediate the two piston ports.

SUMMARY OF THE INVENTION

It is an object of the invention to provide in a pneumatic impact hammer of the type described, a new and improved fluid delivery tube and mounting hub assembly for automatically and sequentially (a) increasing the axial distance that the piston must travel on the piston upstroke before the pressure fluid supply is connected to the back end of the operating chamber and (b) increasing the axial distance the piston must travel on the piston downstroke before the pressure fluid supply is disconnected from the back end of the operating chamber.

It is also an object of the invention to provide in a pneumatic impact hammer of the type described, a new and improved fluid delivery tube and mounting hub assembly that automatically and sequentially increases the differential pressure across the impact piston and maintains such increased differential pressure to increase the impact piston speed on the upstroke and the downstroke.

Other objects and advantages of the invention will become apparent from the drawings and specification.

BRIEF DESCRIPTION OF THE DRAWINGS

The present invention will be better understood and its numerous objects and advantages will become apparent to practitioners in the art by reference to the accompanying drawings in which.

DETAILED DESCRIPTION OF THE PREFERRED EMBODIMENT

Figure 1A:
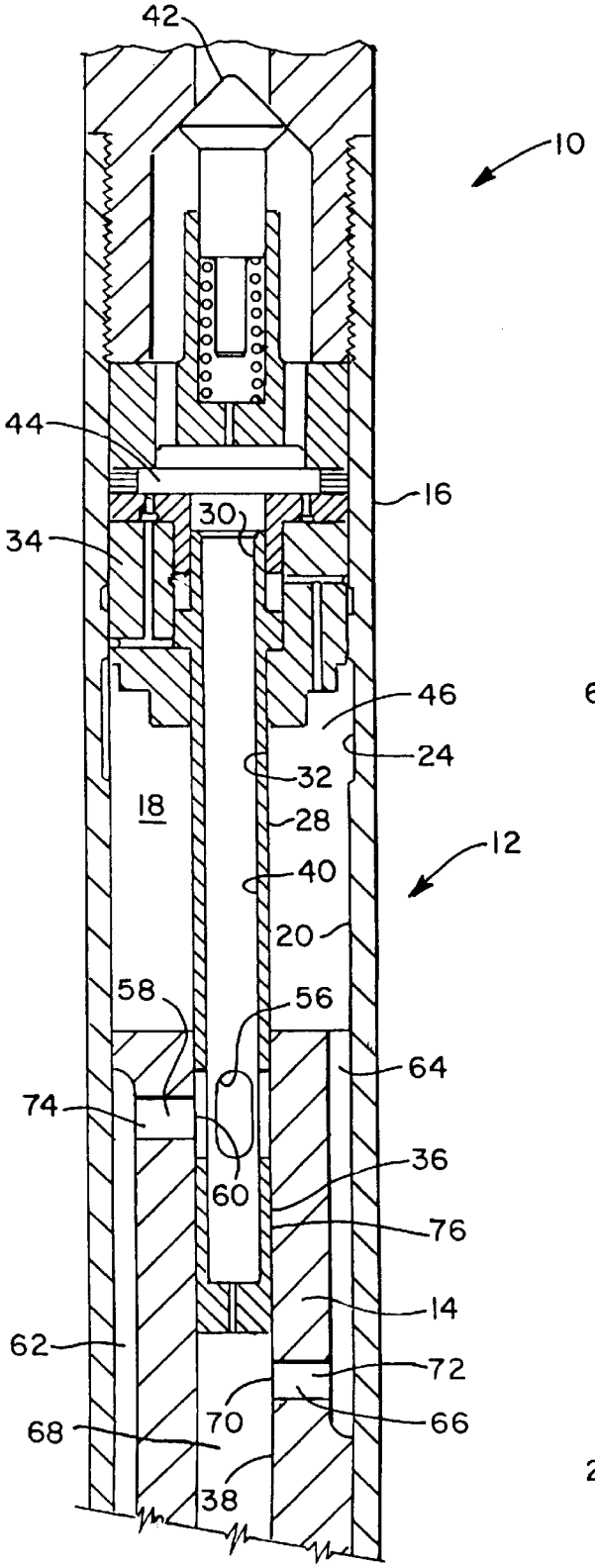
FIGS. 1*a* and 1*b* together provide a longitudinal section view, partly broken away and partly in section, of a downhole impact drill incorporating the present invention and showing an impact piston of the drill in a lower or impact position thereof.

In the drawings, the same numerals are used to designate the same or like parts. The porting system of the present invention has notable utility in downhole impact drills. An example of a downhole impact drill of the type to which the present invention is applicable is disclosed in U.S. Pat. No. 5,205,363, dated Apr. 27, 1993 and entitled "Porting System For Pneumatic Impact Hammer". U.S. Pat. No. 5,205,363, which is incorporated herein by reference, should be referred to for any details not disclosed herein.

FIG. 1 shows a downhole impact drill 10 having an impact hammer 12 incorporating the subject porting system. The downhole hammer 12 has an impact piston 14 reciprocable and rotatable within an outer tubular casing or cylinder 16. The cylinder 16 forms a piston operating chamber 18 and the inner cylindrical surface 20 supports the piston 14 for reciprocation. A pair of axially spaced, internal annular grooves 22, 24 are formed in the cylindrical surface 20. The piston 14 is reciprocated to impact a drill bit 26 mounted within the lower end of the casing 16 in a conventional manner for downhole percussive drilling in a well-known manner.

A fluid delivery tube 28 is coaxially mounted within the upper end of the cylinder 16 for supplying pneumatic pressure fluid for reciprocating the piston 14. The upper end portion 30 of the delivery tube 28 is slidably received within a stepped coaxial bore 32 in an upper mounting hub assembly 34. The hub assembly 34 is firmly mounted within the upper end of the casing 16. The lower end portion 36 of the delivery tube 28 is received within a coaxial through bore 38 in the piston 14. During drilling, pressure fluid is continuously supplied to the central axial bore 40 in the tube 28 via an inlet check valve 42 and an inlet plenum 44. Preferably, the fluid is composed of air compressed up to 350 psi or more and a selected amount of lubricating oil and water coolant.

For reciprocating the piston 14, the opposite ends of the piston operating chamber 18 are sequentially connected to exhaust and to receive pressure fluid from the tube 28. As the piston 14 reciprocates, the upper non-impact end of the operating chamber, or back chamber 46, is timely connected to exhaust and pressure fluid is timely supplied to the lower impact end of the operating chamber, or front chamber 48, to raise or withdraw the piston 14 for a succeeding downward impact stroke. Pressure fluid is timely supplied to the back chamber 46, first to decelerate the upward movement of the piston 14 and then to actuate the piston 14 downwardly to impact the drill bit 26. Similarly, as the piston 14 reciprocates, the front chamber 48 is timely connected to exhaust to provide for actuating the piston 14 downwardly with the fluid pressure in the back chamber 46.

The exhaust connection to the front chamber 48 is provided by an exhaust tube 50 having a lower end portion mounted within an axial bore 52 in the upper end of the drill bit 26. The exhaust tube 50 and axial bore 52 form part of an exhaust passageway 54 leading to the lower end of the bit 26. The upper end portion of the exhaust tube 50 is slidably received within the lowest section of the piston bore 38.

Pressure fluid is supplied from the fluid delivery tube 28 via an annular set of angularly spaced, axial slots or ports 56 to the front chamber 48 via an annular set of angularly spaced, radially extending bores 58 drilled in the piston. The bores 58 extend outwardly from their inner end ports 60 to the upper ends of intermediate, peripheral axial grooves 62 in the piston 14. The axial grooves 62 are angularly spaced and cooperate with the lower bypass groove 22 in the casing 16 to timely supply pressure fluid to the front chamber 48.

Figure 1B:
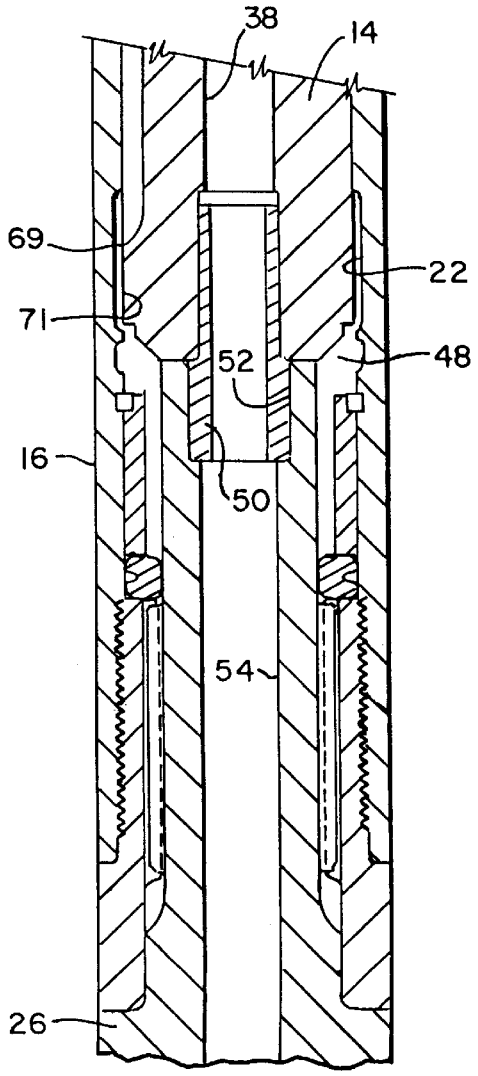

With the impact piston 14 in engagement with the drill bit 26 as shown in FIG. 1B, the back chamber 46 is connected to the exhaust passageway 54 via angularly spaced, peripheral axial grooves 64 extending downwardly from the upper end face of the piston 14. An annular set of angularly spaced, radially extending bores 66 drilled in the piston 14 connect the grooves 64 to an internal sealing section 68 of the piston 14 below the delivery tube 28. The radial bores 66 extend inwardly from the lower ends of the peripheral axial grooves 64 to the back exhaust/supply ports 70. As shown in FIGS. 1A and 1B, the upper end passageway 72 is provided by the upper set of axial grooves 64 and set of drilled bores 66 is completely separate from a lower end passageway 74 provided by the lower set of axial groove 62 and set of drilled bores 58.

With the impact piston 14 in engagement with the drill bit 26, pressure fluid is supplied to the front chamber 48 via the lower end passageway 74 and the back chamber 46 is connected to exhaust via the upper end passageway 72 to provide for raising or withdrawing the piston 14 from the bit 26. As the piston 14 moves upwardly, the fluid pressure connection to the front chamber 48 terminates when the upper edge 69 of the lower piston sealing section 71 engages the inner surface 20 of the casing 16. The piston 14 continues to be actuated upwardly by the pressure below the piston until after the exhaust tube 50 is uncovered to connect the front chamber 48 to exhaust and the pressure in the front chamber 46 drops sufficiently to change the direction of the force on piston 14.

More specifically, the piston 14 moves upwardly from the drill bit 26, the back exhaust/supply ports 70 of the lower end passageway 74 are first sealed off by cooperating sealing sections 76 of the delivery tube 28 and piston 14 and then the back exhaust/supply ports 70 move into registry with the slots 56 to supply pressure fluid to the back chamber 46. The axial location and axial spacing of the sets of drilled inlet ports 60 and back exhaust/supply ports 70 and the axial length and axial position of the elongated slots 56 are established to provide the desired timing and piston stroke.

Figure 2:
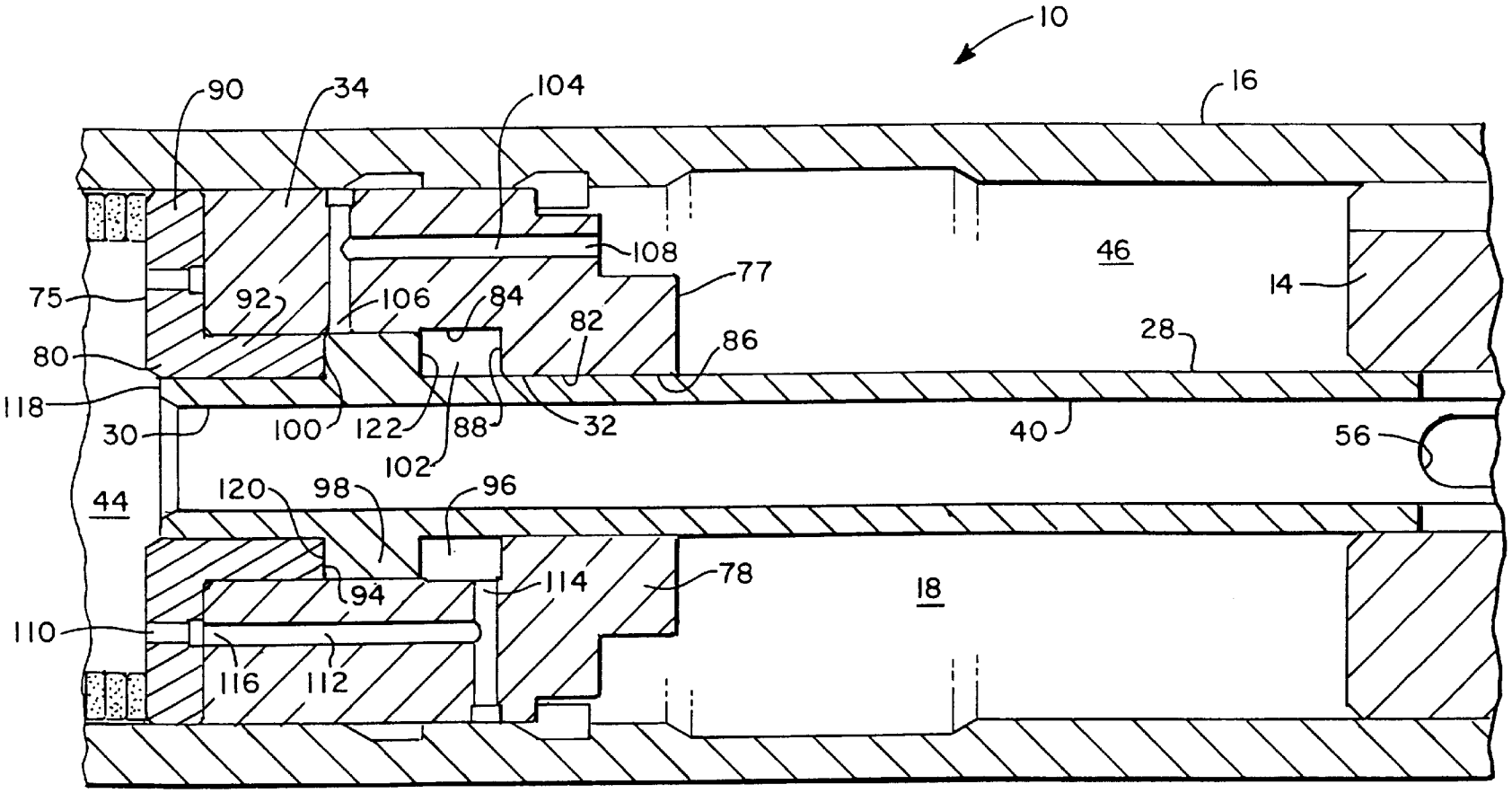
FIG. 2 is an enlarged longitudinal section view, of the mounting hub, cylinder, impact piston, and fluid delivery tube of FIG. 1.

As shown in FIG. 2, the upper mounting hub assembly 34 has inlet plenum and operating chamber ends 75, 77 and includes a lower mounting block 78 and an upper cap 80. A stepped coaxial bore 82 extends through the mounting block 78 and has upper and lower portions 84, 86. The inside diameter of the upper portion 84 is greater than the inside diameter of the lower portion 86 to define a lower shoulder 88. The cap 80 includes a radially extending flange portion 90 and a sleeve portion 92 that extends axially into the upper portion 84 of the mounting block bore 82. The bottom rim 94 of the sleeve portion 92 is axially spaced from the lower shoulder 88 to define an axial cavity 96. A radially extending flange 98 on the delivery tube 28 is reciprocably disposed within cavity 96 to further define upper and lower chambers 100, 102 of the cavity 96. The OD of the delivery tube upper end portion 30 and the ID of the cap sleeve portion 92, the OD of the delivery tube flange 98 and the ID of the cavity 96, and the OD of the delivery tube lower end portion 36 and the ID of the lower portion 86 of the mounting block bore 82, respectively, are closely matched by grinding and honing the parts to provide a fluid seal therebetween.

For reciprocating the delivery tube 28, the upper cavity chamber 100 is sequentially connected to exhaust and to receive pressure fluid via the back chamber 46. As the delivery tube 28 reciprocates, the upper cavity chamber 100 is timely connected to exhaust to raise the delivery tube 28. Similarly, the upper cavity chamber 100 is timely connected to the fluid pressure in the back chamber 46 to lower the delivery tube 28.

The connection between the upper cavity chamber 100 and the back chamber 46 is provided by a passageway 104 having an upper end 106 opening into the upper cavity chamber 100 and a lower end 108 opening into the back chamber 46. The passageway 104 may be comprised of intersecting radial and axial bores, as shown in the figures, to facilitate manufacturing. Similarly, the lower cavity chamber 102 is in fluid communication with plenum 44 via an orifice 110 in the cap 80, and a passageway 112 having a lower end 114 opening into the lower cavity chamber 102 and an upper end 116 which cooperates with the orifice 110 to provide fluid passage therebetween.

Fluid pressure on the delivery tube 28 produces a net force equal to $P1 \times A1 + P2 \times A2 - P3 \times A3$, where A1 is the surface area of the top end 118 of the delivery tube 28, A2 is the surface area of the upper surface 120 of flange 98, and A3 is the surface area of the lower surface 122 of flange 98. Since the lower cavity chamber 102 is always in fluid communication with the plenum 44, $P1=P3$. P2 is a variable pressure and can range from a lower value determined by the back pressure Pe when the upper portion of the operating chamber, or back chamber 46, is fully vented (generally zero to several pounds per square inch) to an upper value that is substantially equal to P1 and P3. Surface areas A1, A2 and A3 are selected such that force $P3 \times A3$ will be greater than the combined force $P1 \times A1 + P2 \times A2$ at a predetermined pressure P4, where $P1, P3 \geqq P4 > Pe$. Preferably, A2 is substantially equal to A3, A3 is substantially equal to 3.75–4 times A1 and P4 is substantially equal to 70–75% of supply pressure P1.

Figure 3A:
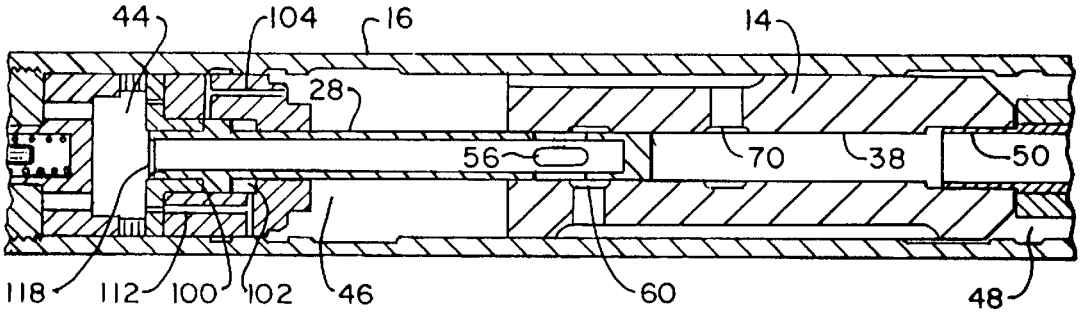
FIGS. 3*a* through 3*i* are longitudinal section views of the mounting hub, cylinder, impact piston, and fluid delivery tube of FIG. 1 showing the positions of the fluid delivery tube and impact piston as the impact piston and fluid delivery tube progressively cycle through a complete stroke from the point when the impact piston has impacted and is beginning an upward stroke (3*a*), at the point when the back exhaust/supply ports are closed to the exhaust (3*b*), when the back exhaust/supply ports start to open to the supply (3*c*), at the point when $P1 \times A1 + P2 \times A2 = P3 \times A3$ (3*d*), at the point when $P1 \times A1 + P2 \times A2 > P3 \times A3$ (3*e*), when the back exhaust/supply ports are closed to the supply (3*f*), when the back exhaust/supply ports begin to open to the exhaust (3*g*), when the back exhaust/supply ports are open to the exhaust and $P1 \times A1 + P2 \times A2 = P3 \times A3$ (3*h*), and just prior to impact when $P1 \times A1 + P2 \times A2 < P3 \times A3$ (3*i*).

FIGS. 2 and 3*a* show the subject drill at the beginning of the piston upward stroke. The piston 14 is in the impact position, where the impact piston 14 is in engagement with the drill bit 26, and the back chamber 46 and the upper cavity chamber 100 are fully exhausted. Consequently, $P1 \times A1 + P2 \times A2 < P3 \times A3$ and the delivery tube 28 has been biased to the upstroke position. The pressure force in the front chamber 48 is greater than the pressure force in the back chamber 46, providing the biasing force required to move the impact piston 14 upward. As can be seen from FIG. 3*a*, the lower portion of the delivery tube slots 56 remain in registry with the inner end ports 60 of passageways 74 for a longer period of time when the delivery tube 28 is in the upstroke position.

The position of the upper edge 69 of the lower piston sealing section 71 relative to the inner surface 20 of the casing 16 and grooves 22 determines whether or not the front chamber 48 is in fluid communication with the inlet plenum 44. Consequently, the fact that the upward displacement of the delivery tube 28 relative to the piston 14 increases the axial distance that the piston 14 must travel before inner end ports 60 are no longer in registry with the delivery tube slots 56 has no effect on the supply of pressure fluid to the front chamber 48. The upward displacement also increases the axial distance that the piston 14 must travel before back exhaust/supply ports 70 are in registry with the delivery tube slots 56.

Figure 3B:
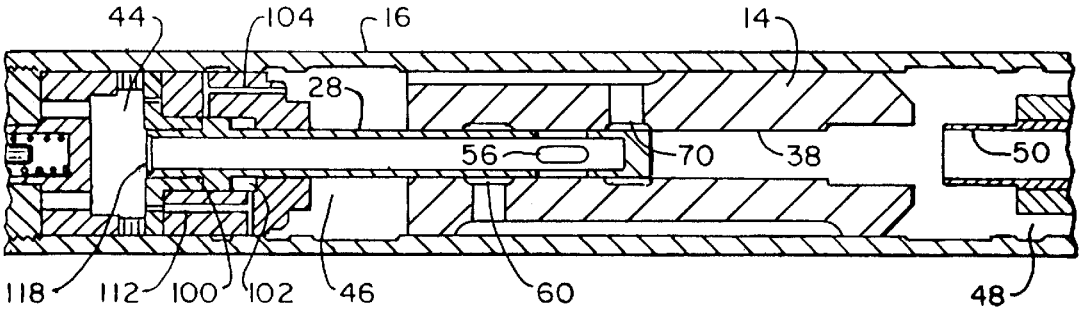
Figure 3C:
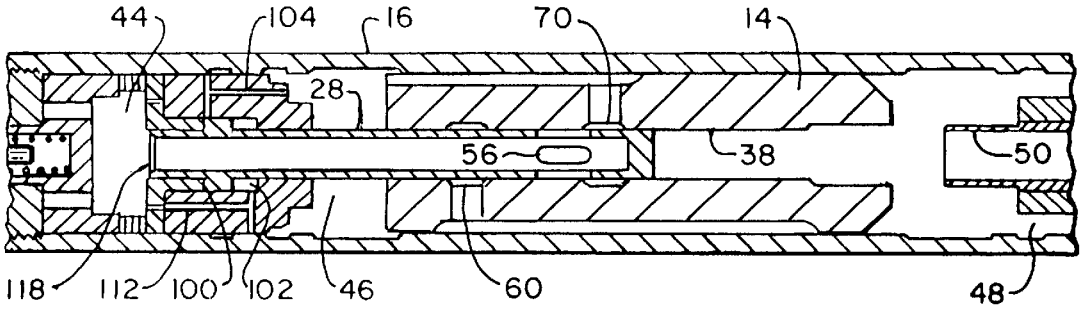

In FIG. 3*b*, the impact piston 14 has moved upward sufficiently to close the exhaust/supply ports 70 to the exhaust and open the front chamber 48 to the exhaust. From this point until the exhaust/supply ports 70 opens to the supply, the air trapped in the back chamber 46 is compressed by the upward stroke of the impact piston 14. In FIG. 3*c*, the exhaust/supply ports 70 begins to open to the supply due to the upward movement of the impact piston 14. As the piston 14 continues upward, the back chamber 46 and upper cavity chamber 100 are pressurized via the inlet plenum 44, the delivery tube 28 and passageway 104, the front chamber 48 is exhausted via the exhaust tube 50, and the pressure in the upper cavity chamber 100 begins to increase from Pe to P4.

Figure 3D:
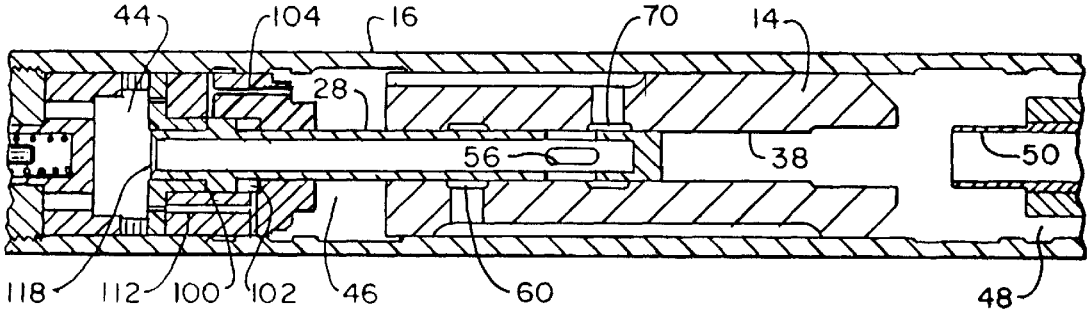
Figure 3E:
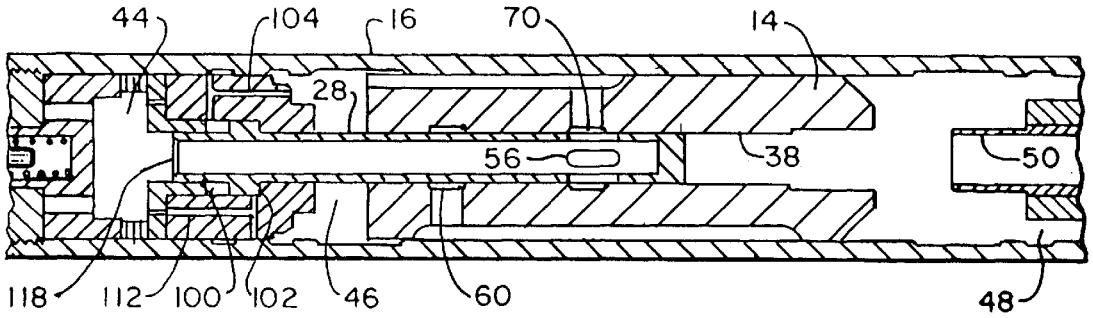

In FIG. 3*d*, the upper cavity chamber 100 has been pressurized to the point where P×A1+P2×A2=P3×A3. In FIG. 3*e*, the upper cavity chamber 100 is pressurized to P4 (P1×A1+P2×A2>P3×A3) and the delivery tube 28 is biased to the downstroke position. The impact piston 14 continues to move upward to the recovery position, where the impact end of the impact piston is at the greatest distance from the drill bit 26, and begins to move downward when the pressure force on the non-impact end of the impact piston 14 has overcome the upward momentum of the piston and it exceeds the pressure force on the impact end of the impact piston 14.

The downward displacement of the delivery tube 28 relative to the piston 14 increases the axial distance that the piston 14 must travel before the back exhaust/supply ports 70 are no longer in registry with the delivery tube slots 56. The downward displacement also increases the axial distance that the piston 14 must travel before the back exhaust/supply ports 70 are in registry with the piston bore 38.

Figure 3F:
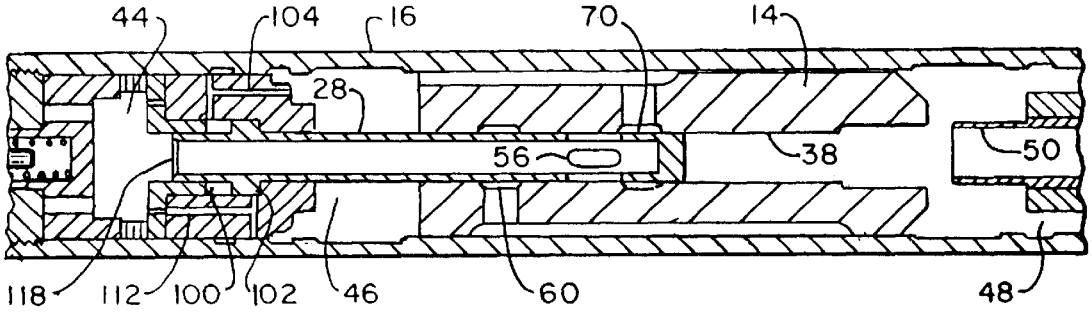
Figure 3G:
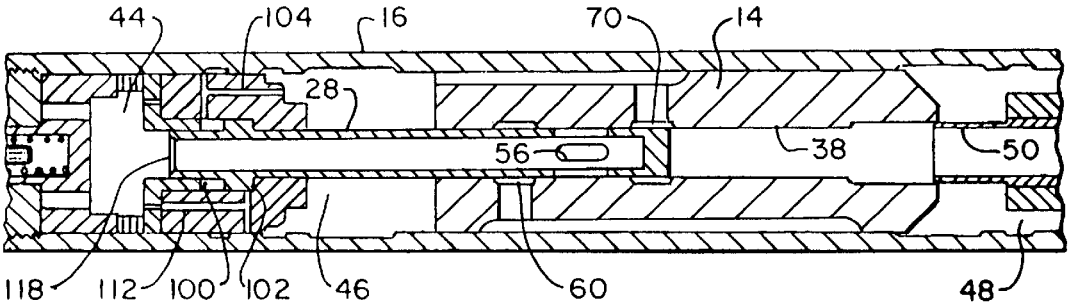
Figure 3H:
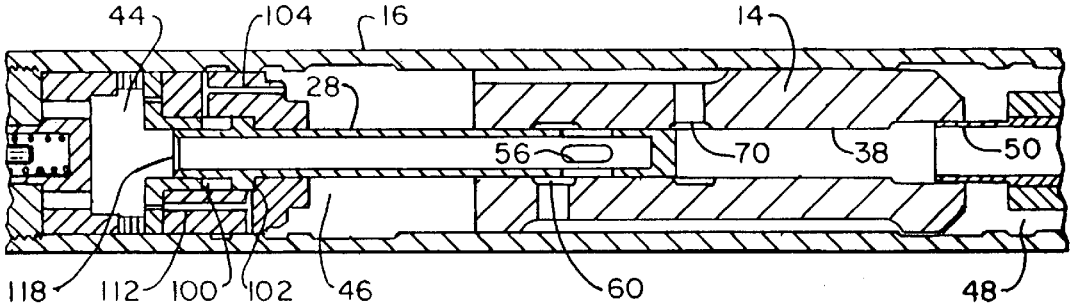

In FIG. 3*f*, the downward movement of the impact piston 14 has closed the back exhaust/supply ports 70 to the supply. Continued downward movement of the impact piston 14 closes the front chamber 48 to the exhaust and initiates opening of the back exhaust/supply ports 70 to the exhaust, as shown in FIGS. 3*g* and 3*h*, respectively. A comparison of FIGS. 3*f* and 3*g* to FIGS. 3*c* and 3*b*, respectively, clearly indicates that an impact drill 10 in accordance with the invention maintains a high pressure force on the back of the impact piston for a longer period of time than conventional drills, increasing the blow energy of the impact piston 14.

Figure 3I:
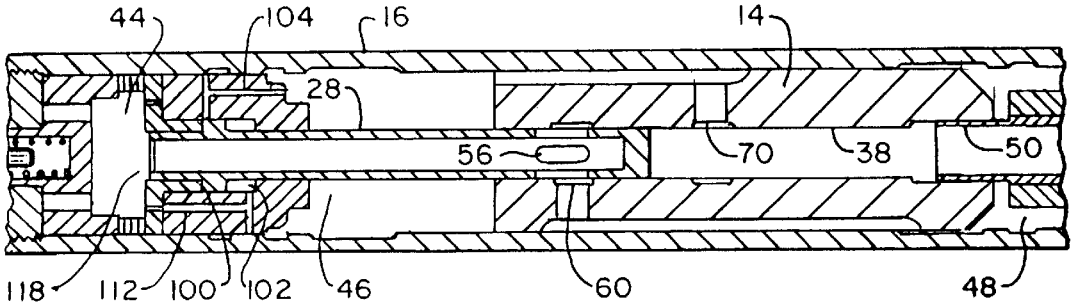

In FIG. 3*h*, downward movement of the impact piston 14 has initiated opening of the inner ports 60 to the supply and the pressure in the back chamber 46 has fallen to the point when P1×A1+P2×A2=P3×A3. In FIG. 3*i*, the impact piston 14 is about to impact the drill bit 26, the upper cavity chamber 100 is depressurized to the point that P1×A1+P2×A2<P3×A3, and the delivery tube 28 is biased to the upstroke position. After the impact piston 14 impacts the drill bit 26, the impact piston 14 and fluid delivery tube 28 are in the positions shown in FIG. 3*a*.

It should be appreciated that by repositioning the delivery tube 28 in the manner described above, the speed of the piston 14 may be increased over the speed which may be achieved by using a delivery tube having a fixed position. The delivery tube 28 is displaced upward relative to the piston 14 (upstroke position) at the beginning of the piston upward stroke and downward relative to the piston 14 (downstroke position) at the beginning of the downward stroke. The upward displacement of the delivery tube 28 relative to the piston 14 increases the axial distance that the piston 14 must travel before the back chamber 46 is connected to the supply of pressurized fluid. Consequently, a greater differential pressure is developed across the piston 14 and such differential pressure is maintained for a longer period of time. Similarly, the downward displacement of the delivery tube 28 relative to the piston 14 increases the axial distance that the piston 14 must travel before the back chamber 46 is disconnected from the supply of pressurized fluid. The increased differential pressure across the piston 14 provides a greater motive force to bias the piston 14, increasing the speed of ascent or descent.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a downhole impact drill comprising an elongated cylinder, a mounting hub assembly fixedly mounted in the cylinder and dividing the cylinder into a pressure fluid inlet plenum and an impact piston operating chamber, an impact piston with oppositely disposed ends and an axial through bore mounted in the operating chamber for reciprocation between an impact position and a recovery position, the operating chamber and impact piston each having non-impact and impact ends at the opposite ends of the piston, exhaust means for selectively connecting either the impact end of the operating chamber or the axial bore of the piston to exhaust, and an elongated pressure fluid delivery tube reciprocable between an upstroke position wherein the fluid delivery tube is disposed nearer to the pressure fluid inlet plenum and a downstroke position, wherein the fluid delivery tube is disposed nearer to the exhaust means, the mounting hub assembly having an axial through bore, operating chamber and inlet plenum ends at opposite ends of the mounting hub assembly, a cavity extending radially from the axial bore having a fluid plenum end and an operating chamber end, first fluid passageway means extending from the fluid plenum end of the mounting hub assembly to the operating chamber end of the cavity to provide fluid communication between the operating chamber end of the cavity and the pressure fluid inlet plenum, second fluid passageway means extending from the operating chamber end of the mounting hub assembly to the fluid plenum end of the cavity to provide fluid communication between the fluid inlet plenum end of the cavity and the non-impact end of the operating chamber, the fluid delivery tube having a first end disposed adjacent the inlet plenum, a first end portion including a radially extending flange slidably mounted within the axial bore of the mounting hub assembly and an oppositely disposed second end portion slidably extending into the axial bore of the piston at the non-impact end thereof, the flange of the first end portion having a first surface adjacent the fluid plenum end of the cavity exposed alternately to the pressurized fluid and the exhaust via the second fluid passageway means and a second surface adjacent the opening chamber end of the cavity continually exposed to the pressurized fluid via the first fluid passageway means, the delivery tube further having an inlet in fluid communication with the pressure fluid inlet plenum and at least one peripheral outlet port for the delivery of pressure fluid, the piston having first and second separate bore means comprising at least one radially extending bore in the piston, the first and second radially extending bores having respective first and second inlet ports, the first inlet port being spaced an axial distance from the second inlet port, the second inlet port being disposed axially closer to the non-impact end of the piston than the first inlet port is disposed axially relative to the non-impact end of the piston, the first and second inlet ports cooperating with the outlet ports at different axial positions of the piston as the piston reciprocates between the impact position and the recovery position to alternately supply pressure fluid from the outlet ports to the non-impact and impact ends of the operating chamber, wherein the axial distance that the piston must move to start supplying pressure fluid to the non impact end of the operating chamber is increased when the delivery tube is in the upstroke position and the axial distance that the piston must move to stop supplying pressure fluid to the non-impact end of the operating chamber is increased when the delivery tube is in the downstroke position.

2. The downhole impact drill of claim 1 wherein the first end of the fluid delivery tube has a surface area A1, the first surface of the delivery tube flange has a surface area A2 and the second surface of the delivery tube flange has a surface area A3, wherein A3>A1 and A1+A2>A3.

3. The downhole impact drill of claim 1 wherein the flange of the fluid delivery tube and the cavity of the mounting hub assembly have respective external and internal sealing sections in sealing engagement.

4. The downhole impact drill of claim 1 wherein the mounting hub assembly further comprises a mounting block and a cap, the mounting block having an axial bore having first and second portions, the first and second portions of the bore of the mounting block each having an inside diameter, the inside diameter of the first portion being greater than the inside diameter of the second portion to define a shoulder, the cap having a radially extending flange and a sleeve axially extending into the first portion of the bore of the mounting block to a distal end, the shoulder and the distal end defining the cavity.

5. The downhole impact drill of claim 4 wherein the mounting block has operating chamber and inlet plenum ends, the cap is disposed intermediate the inlet plenum end of the mounting block and the inlet plenum, the first fluid passageway comprises an opening in the flange of the cap, a first radially extending bore having an end in fluid communication with the operating chamber end of the cavity, and a first axial bore having a first end in fluid communication with the opening in the flange of the cap and a second end in fluid communication with the first radial bore, and the second fluid passageway comprises a second radially extending bore having an end in fluid communication with the fluid plenum end of the cavity, and a second axial bore having a first end in fluid communication with the non-impact end of the operating cavity and a second end in fluid communication with the second radial bore.

6. In a downhole impact drill comprising an elongated cylinder, a mounting hub assembly with an axial through bore fixedly mounted in the cylinder and defining a pressure fluid inlet plenum for receiving a pressure fluid and an impact piston operating chamber, an impact piston with oppositely disposed ends and an axial through bore mounted in the operating chamber for reciprocation, the operating chamber and impact piston each having non-impact and impact ends at the opposite ends of the piston, exhaust means for selectively connecting either the impact end of the operating chamber or the axial bore of the piston to exhaust, the exhaust having a pressure Pv, and an elongated pressure fluid delivery tube having a first end disposed adjacent the inlet plenum having an area A1 exposed to the pressure fluid in the inlet plenum having a pressure P1, a first end portion slidably mounted within the axial bore of the mounting hub assembly and an oppositely disposed second end portion slidably extending into the axial bore of the piston at the non-impact end thereof, the first end portion of the delivery tube having an inlet in fluid communication with the pressure fluid inlet plenum, the second end portion having at least one peripheral outlet port for the delivery of pressure fluid, the piston having first and second separate bore means comprising at least one radially extending bore in the piston, the first and second radially extending bores having respective first and second, axially spaced inlet ports the second inlet port being disposed axially closer to the non-impact end of the piston than the first inlet port is disposed axially relative to the non-impact end of the piston, the first and second inlet ports cooperating with the outlet port at different axial positions of the piston as the piston reciprocates to alternately supply pressure fluid from the outlet ports to the non-impact and impact ends of the operating chamber respectively, the non-impact end of the operating chamber having a maximum pressure of P1, the mounting hub assembly having an operating chamber end, an oppositely disposed fluid plenum end, a cavity extending radially from the axial bore having a fluid plenum end and an operating chamber end, first fluid passageway means extending from the fluid plenum end of the mounting hub assembly to the operating chamber end of the cavity to provide fluid communication between the operating chamber end of the cavity and the pressure fluid inlet plenum, second fluid passageway means extending from the operating chamber end of the mounting hub assembly to the fluid plenum end of the cavity to provide fluid communication between the fluid inlet plenum end of the cavity and the non-impact end of the operating chamber, the delivery tube further having a radially extending flange disposed within the cavity, the flange having a first surface adjacent the fluid plenum end of the cavity having an area A2 exposed alternately to fluid having a pressure P2 equal to the pressure in the non-impact end of the operating chamber via the second fluid passageway, P2 having a variable value of $Pv \leqq P2 \leqq P1$, and a second surface adjacent the operating chamber end of the cavity having an area A3 exposed continuously to pressure fluid having a pressure P1 via the first fluid passageway means, wherein the fluid delivery tube is urged to an upstroke position wherein the fluid delivery tube is disposed nearer to the pressure fluid inlet plenum when $P1 \times A1 + P2 \times A2 + P1 \times A3 < 0$, and the fluid delivery tube is urged to a downstroke position wherein the fluid delivery tube is disposed nearer to the exhaust means when $P1 \times A1 + P2 \times A2 - P1 \times A3 > 0$, wherein the fluid delivery tube delays introduction of pressure fluid into the non impact end of the operating chamber in the upstroke position and prolongs introduction of pressure fluid into the non impact end of the operating chamber in the downstroke position.

7. The downhole impact drill of claim 6 wherein A3>A1 and A1+A2>A3.

8. The downhole impact drill of claim 6 wherein the flange of the fluid delivery tube and the cavity of the mounting hub assembly have respective external and internal sealing sections in sealing engagement.

* * * * *

UNITED STATES PATENT AND TRADEMARK OFFICE

CERTIFICATE OF CORRECTION

PATENT NO. : 5,984,021
DATED : November 16, 1999
INVENTOR(S) : Pascale

It is certified that error appears in the above-identified patent and that said Letters Patent is hereby corrected as shown below:

In claim 1, column 7, line 1, delete "opening" and insert

--operating--.

In claim 6, column 8, line 51, delete "P1xA1 + P2xA2 + P1xA3 < 0" and insert --P1xA1 + P2xA2 - P1xA3 < 0--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*